US010203160B2

(12) United States Patent
Wilkins et al.

(10) Patent No.: US 10,203,160 B2
(45) **Date of Patent: *Feb. 12, 2019**

(54) COOLING MODULE

(71) Applicant: Hanon Systems, Daejeon (KR)

(72) Inventors: Keith Roland Wilkins, Daejeon (KR); Richard Steven Armsden, Daejeon (KR); Nigel Seeds, Daejeon (KR); Leo Somhorst, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/642,959

(22) Filed: Jul. 6, 2017

(65) Prior Publication Data

US 2017/0299270 A1 Oct. 19, 2017

Related U.S. Application Data

(62) Division of application No. 14/459,617, filed on Aug. 14, 2014, now Pat. No. 9,733,022.

(30) Foreign Application Priority Data

Aug. 14, 2013 (KR) ..... 10-2013-0096841

(51) Int. Cl.
*F28D 1/00* (2006.01)
*F28D 1/04* (2006.01)
(Continued)

(52) U.S. Cl.
CPC ..... *F28D 1/0435* (2013.01); *F28D 1/05366* (2013.01); *F28D 2021/0031* (2013.01);
(Continued)

(58) Field of Classification Search
CPC ..... F28D 1/0435; F28D 1/05366; F28D 2021/0031; F28D 2021/0084;
(Continued)

(56) References Cited

U.S. PATENT DOCUMENTS 4,063,431 A 12/1977 Dankowski
5,816,350 A 10/1998 Akira et al.
(Continued)

FOREIGN PATENT DOCUMENTS

FR 2726325 A1 5/1996
GB 2431714 A 5/2007
(Continued)

*Primary Examiner* — Davis D Hwu
(74) *Attorney, Agent, or Firm* — Shumaker, Loop & Kendrick, LLP; James D. Miller

(57) ABSTRACT

A cooling module including a first heat exchanger cooling a first heat exchange medium, a second heat exchanger cooling a second heat exchange medium, a third heat exchanger cooling a third heat exchange medium, and a fan and shroud assembly arranged in parallel in an air flow direction, wherein a flow of the first heat exchange medium inside first tubes forming the first heat exchanger is perpendicular to a flow of the second heat exchange medium inside second tubes forming the second heat exchanger and parallel with a flow of the third heat exchange medium inside third tubes forming the third heat exchanger. The cooling module capable of sufficiently securing the first heat exchange medium condensing performance, the third heat exchange medium cooling performance, and the second heat exchange medium cooling performance and being miniaturized.

6 Claims, 11 Drawing Sheets

(51) Int. Cl.
*F28D 1/053* (2006.01)
*F28D 21/00* (2006.01)

(52) U.S. Cl.
CPC ..... *F28D 2021/0084* (2013.01); *F28D 2021/0094* (2013.01); *F28F 2240/00* (2013.01); *F28F 2265/30* (2013.01)

(58) Field of Classification Search
CPC ..... F28D 2021/094; F28D 15/00; F28D 1/04; F28D 1/06; F28F 2240/00; F28F 2265/30; F01P 3/18
USPC ..... 165/148
See application file for complete search history.

(56) References Cited

U.S. PATENT DOCUMENTS

| | | | | |
|---|---|---|---|---|
| 5,992,514 | A | 11/1999 | Sugimoto et al. | |
| 6,000,460 | A | 12/1999 | Yamanaka et al. | |
| 6,059,019 | A | 5/2000 | Brost et al. | |
| 6,200,542 | B1 | 3/2001 | Poles et al. | |
| 6,789,613 | B1 * | 9/2004 | Ozaki | F01P 3/18 165/132 |
| 9,062,901 | B2 | 6/2015 | Jeon et al. | |
| 10,018,422 | B2 * | 7/2018 | Wilkins | F28D 1/0435 |

FOREIGN PATENT DOCUMENTS

| | | | |
|---|---|---|---|
| JP | H0257421 | A | 2/1990 |
| JP | H08200066 | A | 8/1996 |
| JP | 2002115992 | A | 4/2002 |
| JP | 2005024227 | A | 1/2005 |
| JP | 2005343221 | A | 12/2005 |
| JP | 2007192462 | A | 8/2007 |
| JP | 2012247120 | A | 12/2012 |
| KR | 20100059490 | A | 6/2010 |
| KR | 20120137857 | A | 12/2012 |
| KR | 20130012986 | A | 2/2013 |

* cited by examiner

FIG. 1A – PRIOR ART
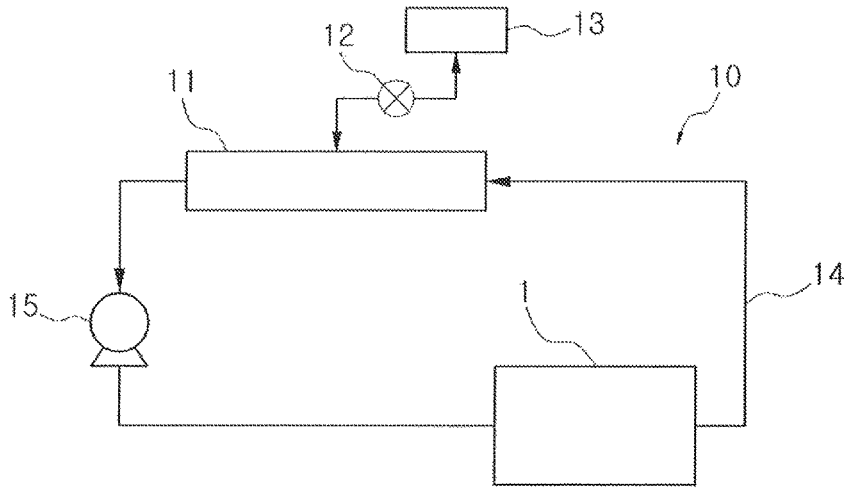
FIG. 1B – PRIOR ART
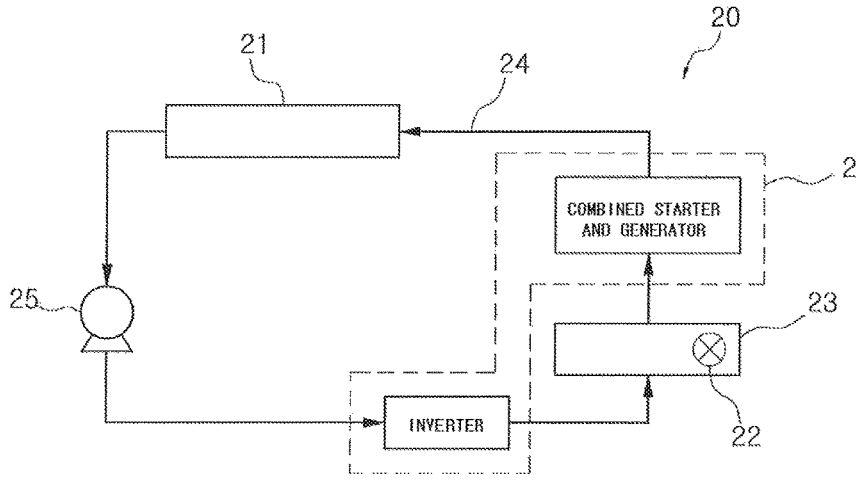

FIG. 2 – PRIOR ART
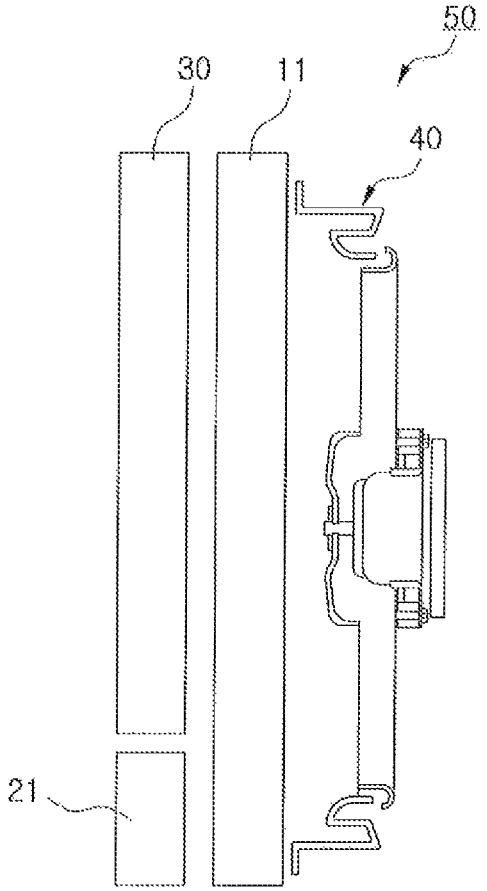

COOLING MODULE

CROSS-REFERENCE TO RELATED PATENT APPLICATIONS

This patent application is a divisional patent application of U.S. patent application Ser. No. 14/459,617 filed Aug. 14, 2014 which claims priority to Korean Patent Application No. 10-2013-0096841, filed on Aug. 14, 2013, the entire disclosures of which are incorporated herein by reference.

FIELD OF THE INVENTION

Exemplary embodiments of the present invention relate to a cooling module, and more particularly, to a cooling module capable of sufficiently securing coolant condensing performance, engine cooling water cooling performance, and electronic component cooling water cooling performance and being miniaturized.

BACKGROUND OF THE INVENTION

Generally, in a vehicle in which an internal combustion engine is mounted, heat generated at the time of an operation of an engine is conducted to a cylinder head, a piston, a valve, and the like. Therefore, when a temperature of components is excessively increased, a strength of the components is reduced, engine lifespan is reduced, and a combustion state is also poor in response to thermal expansion or deterioration to lead to knocking or pre-ignition, thereby reducing an output of the engine.

Further, when the engine is incompletely cooled, a lubricating function such as a separation of an oil film of an inner circumferential surface of the cylinder is reduced and engine oil is spoiled, such that an abnormal abrasion of the cylinder may be caused and the piston may be fused to an inner wall of the cylinder.

Meanwhile, in the vehicle, electronic components which are electric and electronic components including a motor, an inverter, a battery stack, and the like in addition to the engine need to be cooled. Therefore, cooling water passing through the engine and cooling water passing through the electronic components have a predetermined difference in temperature. As a result, the vehicle does not have a single cooling system.

FIGS. 1A and 1B illustrate a cooling system for a vehicle, in which FIG. 1A illustrates an engine cooling system 10 and FIG. 1B illustrates an electronic component cooling system 20.

In more detail, an engine cooling system 10 is configured to include a water pump 15 which circulates cooling water for cooling an engine 1, a first radiator 11 which cools the cooling water, a first cooling water storage tank 13 which supplies the cooling water to the first radiator 11, and a first cooling water control cap 12.

In the engine cooling system 10, the first radiator 11, the water pump 15, and the engine 1 are connected to one another through a first connection line 14.

Further, the electronic component cooling system 20 is configured to include a water pump 25 which circulates cooling water for cooling an electronic component 2, a second radiator 21 which cools the cooling water, a second cooling water storage tank 23 which supplies the cooling water to the second radiator 21, and a second cooling water control cap 22.

In this configuration, the electronic component cooling system 20 illustrates an example in which the electronic component 2 is configured to include an inverter and a combined starter and generator.

Further, similar to the engine cooling system 10, in the electronic component cooling system 20, the second radiator 21, the water pump 24, and the electronic component 2 are also connected to one another through a second connection line 24.

In this configuration, the first radiator 11 and the second radiator 21 configure a cooling module 50, including a condenser 30 and a fan and shroud assembly 40 and are heat exchanged with traveling wind and air introduced through the fan and shroud assembly 40.

FIG. 2 illustrates an example of the cooling module 50.

However, in the case of the form illustrated in FIG. 2, a size of the condenser 30 is reduced by a formation area of the second radiator 21, and therefore the condenser 30 is difficult to obtain sufficient condensing efficacy and the second radiator 21 is also difficult to sufficiently secure an amount of cooling water flowing therein.

Meanwhile, as another cooling module 50, an example in which the first radiator 11, the second radiator 21, and the condenser 30 are arranged in parallel is proposed, but a size of the cooling module 50 is increased due to a thickness of the components themselves and an interval between the components and thus the cooling module 50 is difficult to be miniaturized.

Therefore, there is a need to develop a cooling module capable of being miniaturized while sufficiently securing the performance of each of the first radiator, the second radiator, and the condenser which configure the cooling module.

SUMMARY OF THE INVENTION

There is a need to provide a cooling module capable of sufficiently securing first heat exchange medium condensing performance, third heat exchange medium cooling performance, and second heat exchange medium cooling performance and being miniaturized.

There is a further need to provide a cooling module capable of reducing an interval between the first heat exchanger and the second heat exchanger and an interval between the second heat exchanger and the third heat exchanger by forming in parallel internal flow directions of a first heat exchanger and a third exchanger in which a third heat exchange medium flows and vertically forming internal flow directions of the first heat exchanger and a second heat exchanger in which a second heat exchange medium flows.

There is also a need to provide a cooling module capable of preventing components of a first heat exchanger, a second exchanger, and a third exchanger from contacting each other using an interval keeping means or structure while reducing an interval between a first heat exchanger and a second heat exchanger and an interval between the second heat exchanger and a third exchanger to militate against vibration and noise from occurring and more increase durability.

Other needs and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, there is provided a cooling module in which a first heat exchanger, a second heat exchanger cooling a second heat exchange medium, a third heat exchanger cooling a third heat exchange medium, and a fan and shroud assembly are arranged in parallel in an air flow direction, wherein a flow of first heat exchange medium inside first tubes forming the first heat exchanger is perpendicular to a flow of second heat exchange medium inside second tubes forming the second heat exchanger and is parallel with a flow of third heat exchange medium inside third tubes forming the third heat exchanger.

The second heat exchanger may be further provided with an interval keeping means which keeps a spaced distance from the first heat exchanger and a spaced distance from the third heat exchanger.

The interval keeping means may be a viscous liquid applied to the second tubes in the second heat exchanger at a predetermined thickness.

The interval keeping means may be a gasket which at least two are provided in a height direction of a vehicle.

The interval keeping means may be a frame which has a predetermined thickness and is fixed to the second tubes or a second fin by a fixing means or structure at a size corresponding to a formation area of the second tubes and the second fin in the second heat exchanger.

The frame may include: a first frame which includes a first support part and a second support part extendedly formed in a width direction of a vehicle and spaced apart from each other by a distance at which the fixing means is inserted in a height direction of a vehicle and a fastening part connecting the first support part and the second support part in the height direction of the vehicle and fastened with the fixing means; a second frame which includes the first support part and the second support part extendedly formed in the width direction of the vehicle and spaced apart from each other by the distance at which the fixing means is inserted in a height direction of a vehicle and a fastening part connecting the first support part and the second support part in the height direction of the vehicle and fastened with the fixing means and is spaced apart from the first frame by a predetermined distance in the height direction of the vehicle; and a third frame and a fourth frame which are extendedly formed in the height direction of the vehicle to connect both ends of the first frame and the second frame, respectively, in the width direction of the vehicle.

The first heat exchanger may include a 1-1-th header tank and a 1-2-th header tank arranged in parallel, spaced part from each other by a predetermined distance in a width direction of a vehicle, the first tubes having both ends fixed to the 1-1-th header tank and the 1-2-th header tank, and a first fin interposed between the first tubes, the second heat exchanger may include a 2-1-th header tank and a 2-2-th header tank arranged in parallel, spaced part from each other by a predetermined distance in a height direction of a vehicle, the second tubes having both ends fixed to the 2-1-th header tank and the 2-2-th header tank, and a second fin interposed between the second tubes, and the third heat exchanger may include a 3-1-th header tank and a 3-2-th header tank arranged in parallel, spaced part from each other by a predetermined distance in a width direction of a vehicle, the third tubes having both ends fixed to the 3-1-th header tank and the 3-2-th header tank, and a third fin interposed between the third tubes.

In the height direction of the vehicle, a height H100 of a formation area of the first tubes and the first fin in the first heat exchanger, a height H200 of a formation area of the second tubes and the second fin in the second heat exchanger, and a height H300 of a formation area of the third tubes and the third fin in the third heat exchanger may be formed to be equal.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIGS. 1A and 1B are diagrams illustrating a cooling system for a vehicle;

FIG. 2 is a schematic side elevational view illustrating a cooling module in accordance with the related art;

DESCRIPTION OF SPECIFIC EMBODIMENTS

Figure 3:
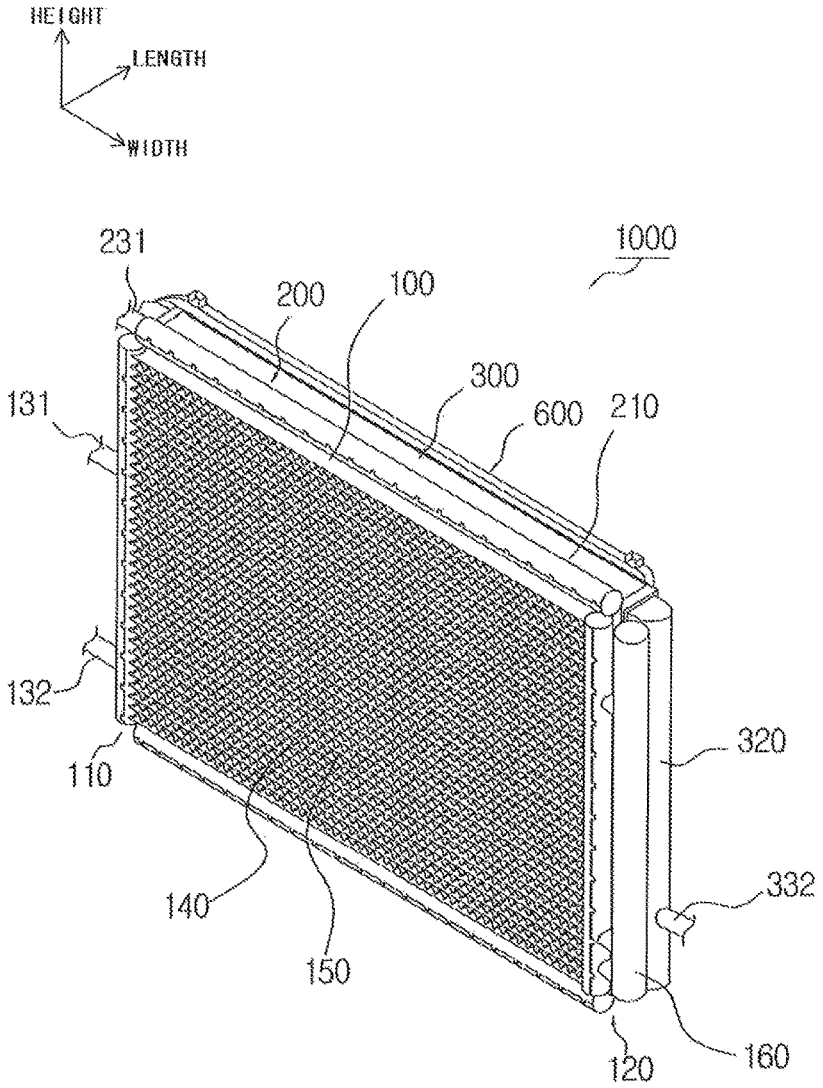
FIGS. 3 to 5 are a perspective view, a schematic side elevational view, and a fragmentary transverse cross-sectional view of the cooling module in accordance with an embodiment of the present invention.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Hereinafter, a cooling module 1000 in accordance with embodiments of the present invention having the above-mentioned characteristics will be described in more detail with reference to the accompanying drawings.

The cooling module 1000 in accordance with the embodiment of the present invention is configured to include a first heat exchanger 100, a second heat exchange 200, a third heat exchanger 300, and a fan and shroud assembly 600, in which a flow of first heat exchange medium inside first tubes 140 forming the first heat exchanger 100 is vertically formed with respect to a flow of a second heat exchange medium inside second tubes 240 forming the second heat exchanger 200 and is parallel with a flow of third heat exchange medium inside third tubes 340 forming the third heat exchanger 300.

The first heat exchanger 100 is a part which is disposed in front of a vehicle engine room to first pass air and is configured to include a 1-1-th header tank 110, a 1-2-th header tank 120, a first inlet pipe 131, a first outlet pipe 132, first tubes 140, and a first fin 150.

In more detail, the first heat exchanger 100 is configured so that the 1-1-th header tank 110 and the 1-2-th header tank 120 are arranged in parallel, spaced apart from each other by a predetermined distance. The 1-1-th header tank 110 and the 1-2-th header tank 120 are provided with the first inlet pipe 131 into which the first heat exchange medium is introduced and the first outlet pipe 132 from which the first heat exchange medium is discharged. The first tubes 140 have both ends fixed to the 1-1-th header tank 110 and the 1-2-th header tank 120 to have the first heat exchange medium flow therein. The first fin 150 is interposed between the first tubes 140 to increase heat exchange efficiency between air and the first heat exchange medium inside the first tubes 140.

Figure 4:
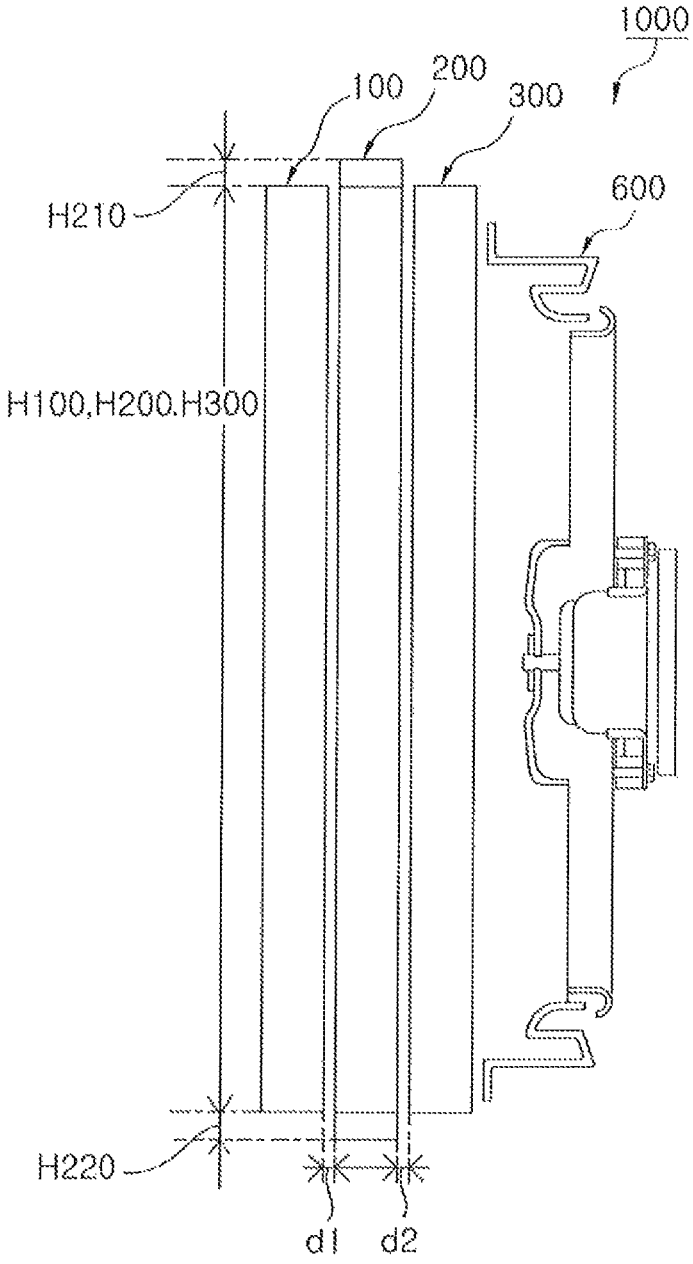

In FIGS. 3 and 4, the first heat exchanger 100 illustrate an example in which a gas-liquid separator 160 separating liquefied and gaseous first heat exchange medium from each other during a transfer of the first heat exchange medium to an expansion valve to supply only the liquefied first heat exchange medium is formed in the 1-2-th header tank 120.

The second heat exchanger 200 is configured to include a 2-1-th header tank 210, a 2-2-th header tank 220, a second inlet pipe 231, a second outlet pipe 232, second tubes 240, and a second fin 250.

In more detail, the second heat exchanger 200 is configured so that the 2-1-th header tank 210 and the 2-2-th header tank 220 are arranged in parallel, spaced apart from each other by a predetermined distance. The 2-1-th header tank 210 and the 2-2-th header tank 220 are provided with the second inlet pipe 231 into which the second heat exchange medium is introduced and the second outlet pipe 232 from which the second heat exchange medium is discharged. The second tubes 240 have both ends fixed to the 2-1-th header tank 210 and the 2-2-th header tank 220 to have the second heat exchange medium flow therein and the second fin 250 is interposed between the second tubes 240 to increase heat exchange efficiency between air and the second heat exchange medium inside the second tubes 240.

The third heat exchanger 300 is configured to include a 3-1-th header tank 310, a 3-2-th header tank 320, a third inlet pipe 331, a third outlet pipe 332, third tubes 340, and a third fin 350.

In more detail, the third heat exchanger 300 is configured so that the 3-1-th header tank 310 and the 3-2-th header tank 320 are arranged in parallel, spaced apart from each other by a predetermined distance. The 3-1-th header tank 310 and the 3-2-th header tank 320 are provided with the third inlet pipe 331 into which the third heat exchange medium is introduced and the third outlet pipe 332 from which the third heat exchange medium is discharged. The third tubes 340 have both ends fixed to the 3-1-th header tank 310 and the 3-2-th header tank 320 to have the third heat exchange medium flow therein and the third fin 350 is interposed between the third tubes 340 to increase heat exchange efficiency between air and the third heat exchange medium inside the third tubes 340.

In this case, in the cooling module 1000 in accordance with the embodiment of the present invention, the flow of the first heat exchange medium inside the first tubes 140 forming the first heat exchanger 100 is vertically formed with respect to the flow of the second heat exchange medium inside the second tubes 240 forming the second heat exchanger 200 and is parallel with the flow of the third heat exchange medium inside the third tubes 340 forming the third heat exchanger 300.

In this case, the first heat exchanger 100 may be a condenser, the second heat exchanger 200 may be an electronic component radiator, and the third heat exchanger 300 may be an engine radiator. When the first heat exchanger 100 is a condenser, the first heat exchanger 100 circulates a refrigerant as the first heat exchange medium, heat-exchanges a high-pressure gaseous first heat exchange medium delivered from a compressor with external air and condenses the high-pressure gaseous first heat exchange medium into a high temperature and high pressure liquid during a process of a cooling cycle, and delivers the high temperature and high pressure liquid to an expander.

Further, when the second heat exchanger 200 is an electronic component radiator, the second heat exchanger 200 has cooling water for cooling electronic components as the second heat exchange medium flow therein and emits heat to the outside while making the second heat exchange medium absorbing heat generated from the electronic components flow so as to prevent electrical components/electronic components from rising to or above a predetermined temperature. In accordance with the embodiment of the present invention, the electronic components are collectively referred to as a driving motor and accessory electrical components such as for a fuel cell vehicle and a hybrid vehicle and an example thereof may include a motor, an inverter, a battery stack, and the like. That is, the second heat exchanger 200 performs heat exchange by making the second heat exchange medium for preventing the electronic components from overheating flow therein.

Further, when the third heat exchanger 300 is an engine radiator, the third heat exchanger 300 has cooling water for cooling an engine as the third heat exchange medium flow therein and emits heat to the outside while making the third heat exchange medium absorbing heat generated from the engine flow so as to prevent the engine from rising to or above a predetermined temperature. That is, the third heat exchanger 300 performs heat exchange by making the third heat exchange medium for preventing the engine from overheating flow therein.

Figure 5:
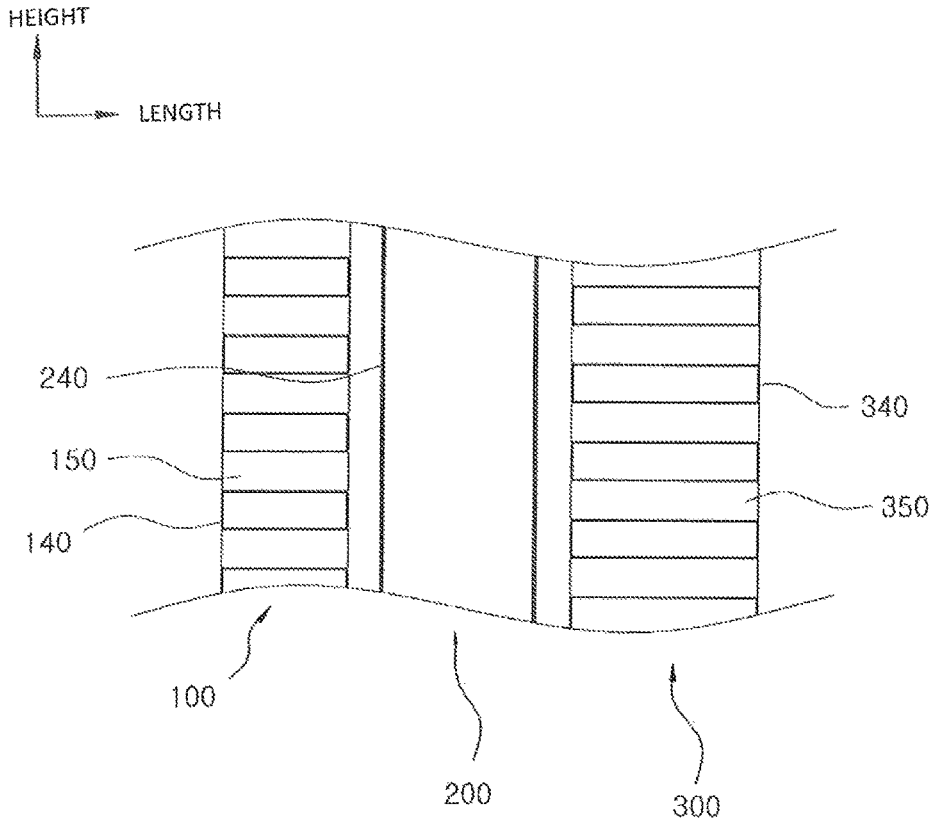
Figure 6:
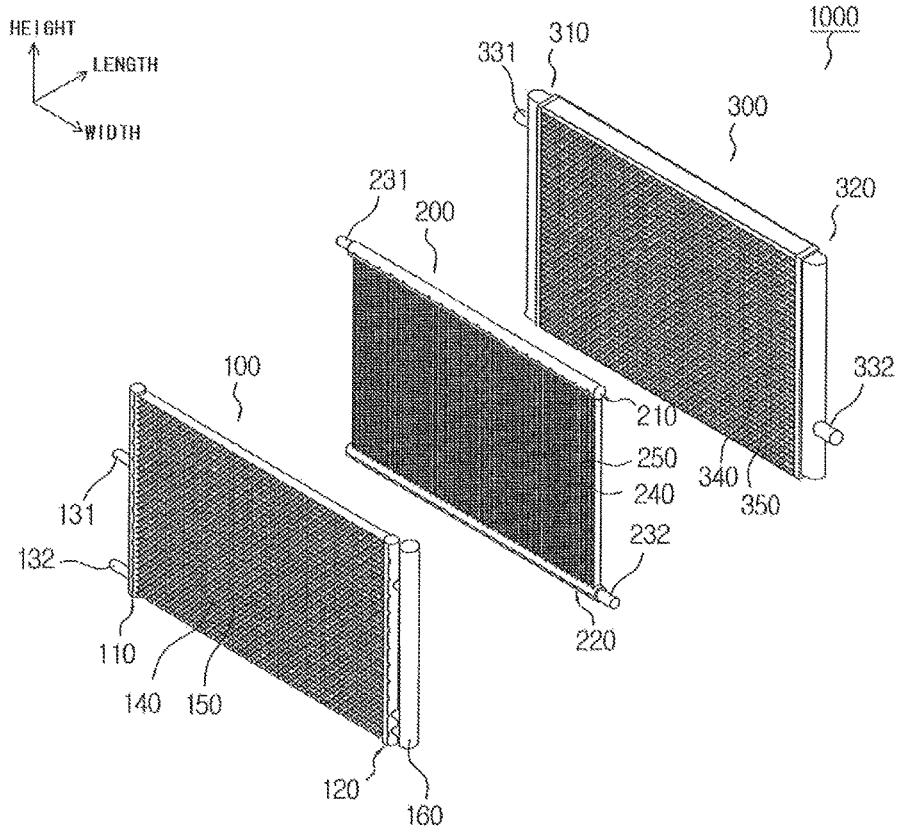
FIG. 6 is a partially exploded perspective view of the cooling module illustrated in FIG. 3.
Figure 7A:
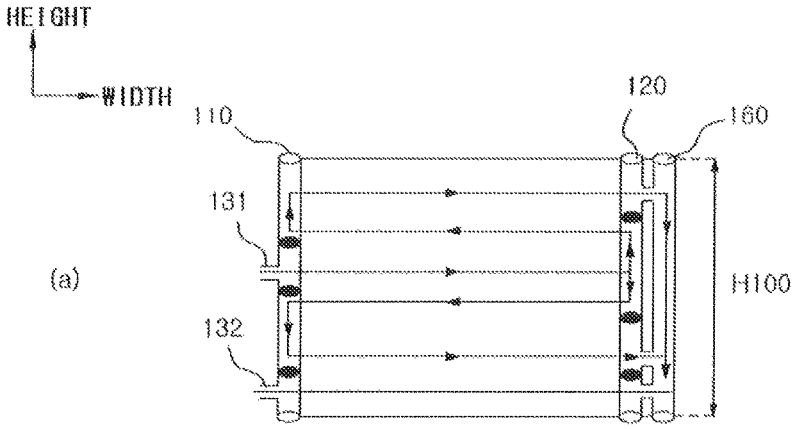
FIGS. 7A to 7C are schematic diagrams illustrating a flow of a first heat exchange medium, a second heat exchange medium, and a third heat exchange medium inside the cooling module illustrated in FIG. 3.
Figure 7B:
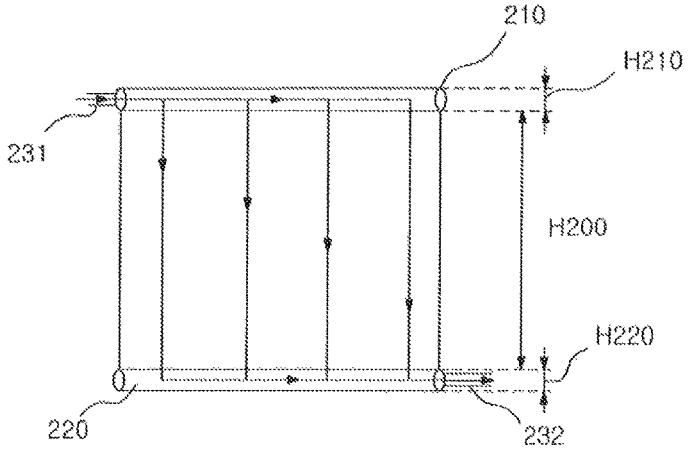
Figure 7C:
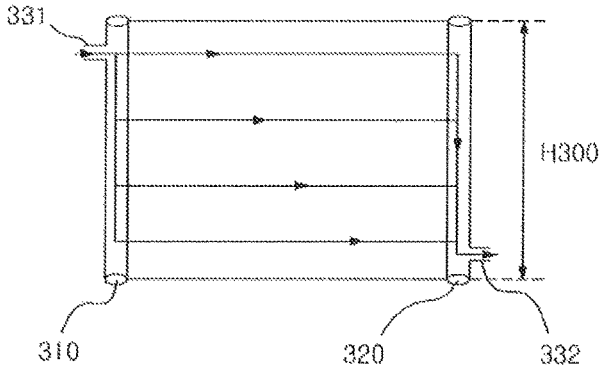

FIGS. 3 to 7 illustrate an example of the cooling module 1000 in accordance with the embodiment of the present invention, in which FIGS. 3 to 5 are a perspective view, a schematic side elevational view, and a fragmentary transverse cross-sectional view of the cooling module 1000 in accordance with an embodiment of the present invention, FIG. 6 is a partially exploded perspective view of the cooling module 1000 illustrated in FIG. 3, and FIGS. 7A to 7C are schematic diagrams illustrating the flow of the first heat exchange medium, the second heat exchange medium, and the third heat exchange medium inside the cooling module 1000 illustrated in FIG. 3. (In more detail, FIG. 7A illustrates an example of the flow of the first heat exchange medium inside the first heat exchanger 100, FIG. 7B illustrates an example of the flow of the second heat exchange medium inside the second heat exchanger 200, and FIG. 7C illustrates an example of the flow of the third heat exchange medium inside the third heat exchanger 300.

Describing in more detail the form illustrated in FIGS. 3 to 7, the 1-1-th header tank 110 and the 1-2-th header tank 120 in the first heat exchanger 100 are disposed to be spaced apart from each other by a predetermined distance in a width direction of a vehicle, the first tube 140 is extendedly formed in the width direction of the vehicle, the 2-1-th header tank 210 and the 2-2-th header tank 220 in the second heat exchanger 200 are disposed to be spaced apart from each other in a height direction of the vehicle, and the second tube 240 is extendedly formed in the height direction of the vehicle.

Further, the 3-1-th header tank 310 and the 3-2-th header tank 320 in the third heat exchanger 300 are disposed to be spaced apart from each other by a predetermined distance in the width of the vehicle and the third tube 340 is extendedly formed in the width direction of the vehicle.

In other words, when the first tube 140 in the first heat exchanger 100 is formed in the width direction of the vehicle, the second tube 240 in the second heat exchanger 200 is formed in the height direction of the vehicle, and the third tube 340 in the third heat exchanger 300 is formed in the width direction of the vehicle.

In this case, a height H100 of the formation area of the first tubes 140 and the first fins 150 in the first heat exchanger 100, a height H200 of the formation area of the second tubes 240 and the second fins 250 in the second heat exchanger 200, and a height H300 of the formation area of the third tubes 340 and the third fins 350 in the third heat exchanger 300 are formed to be equal. (Referring to FIGS. 4 and 7, H100=H200=H300).

To this end, the second heat exchanger 200 is configured so that the 2-1-th header tank 210 is protrudedly formed on a higher portion than the height H100 (the height H300 of the formation area of the third tubes 340 and the third fins 350 in the third heat exchanger 300) of the formation area of the first tubes 140 and the first fins 150 in the first heat exchanger 100 in the height direction of the vehicle and the 2-2-th header tank 220 is protrudedly formed on a lower portion than the height H100 (the height H300 of the formation area of the third tubes 340 and the third fins 350 in the third heat exchanger 300) of the formation area of the first tubes 140 and the first fins 150 in the first heat exchanger 100 in the height direction of the vehicle.

That is, the overall height of the second heat exchanger 200 is equal to a sum of the height H200 of the second tubes 240 and the second fins 250, a height H210 of the 2-1-th header tank 210, and a height H220 of the 2-2-th header tank 220.

By this configuration, the cooling module 1000 in accordance with the embodiment of the present invention may prevent the interval between the second heat exchanger 200 and the first heat exchanger 100 and the interval between the second heat exchanger 200 and the third heat exchanger 300 from increasing in the length direction of the vehicle due to the size of the 2-1-th header tank 210 and the 2-1-th header tank 210 in the second heat exchanger 200, such that the overall size thereof may be miniaturized.

As illustrated in FIGS. 4 and 5, the interval between the second heat exchanger 200 and the first heat exchanger 100 means a distance d1 between the second heat exchanger 200 and the first heat exchanger 100 of a portion in which the first tubes 140, the first fins 150, the second tubes 240, and the second fins 250 are formed and the interval between the second heat exchanger 200 and the third heat exchanger 300 also means a distance d2 between the second heat exchanger 200 and the third heat exchanger 300 of a portion in which the second tubes 240, the second fins 250, the third tubes 340, and the third fins 350 are formed.

Figure 8:
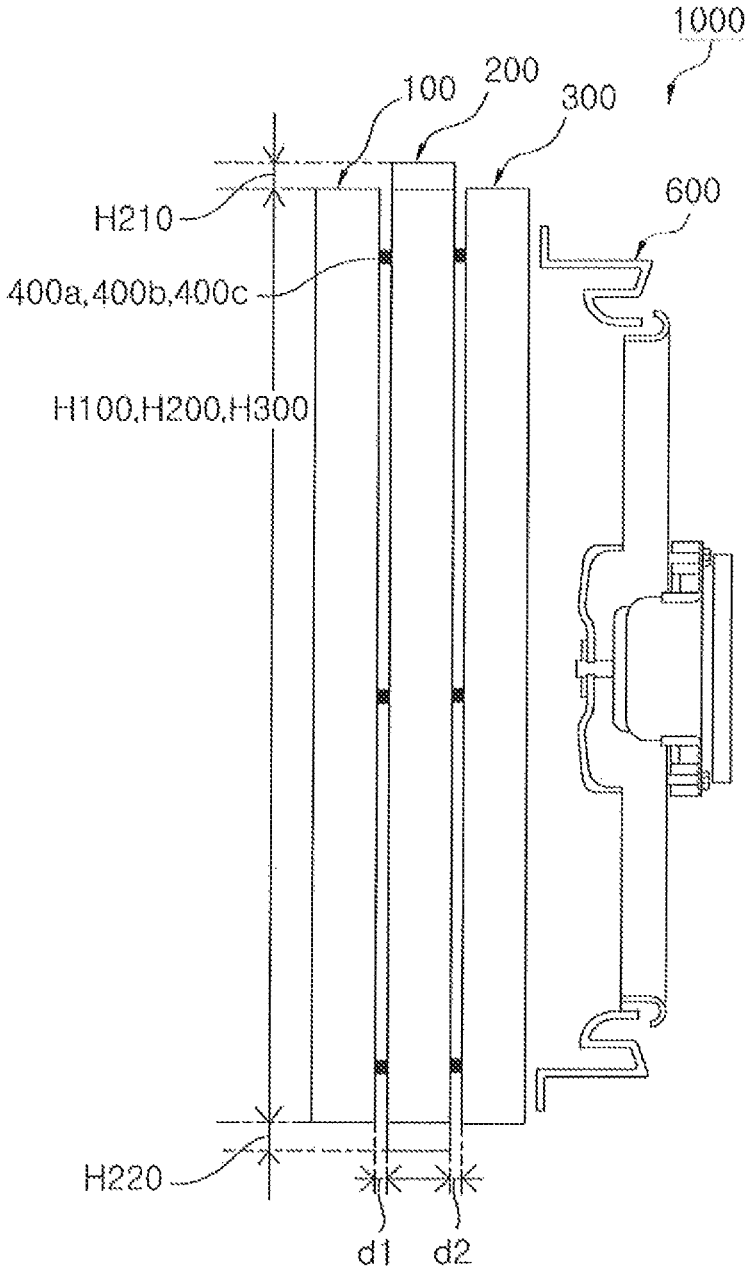
FIG. 8 is a further schematic side elevational view of the cooling module in accordance with the embodiment of the present invention.

Further, the cooling module 1000 in accordance with the embodiment of the present invention may be further provided with an interval keeping means or structure to prevent contact the first heat exchanger 100, the second heat exchanger 200, and the third heat exchanger 300 from contacting one another while making the interval among the first heat exchanger 100, the second heat exchanger 200, and the third exchanger 300 very small. FIG. 8 is another schematic side elevational view of the cooling module 1000 in accordance with the embodiment of the present invention, in which the cooling module 1000 in accordance with the embodiment of the present invention may use the interval keeping means to prevent the occurrence of noise caused by a collision of the first heat exchanger 100, the second heat exchanger 200, and the third heat exchanger 300 due to vibration or prevent the first heat exchanger 100, the second heat exchanger 200, and the third heat exchanger 300 from being damaged.

The interval keeping means may have various shapes in both sides (length direction of a vehicle) of the second heat exchanger 200 and be manufactured by various methods.

Figure 9:
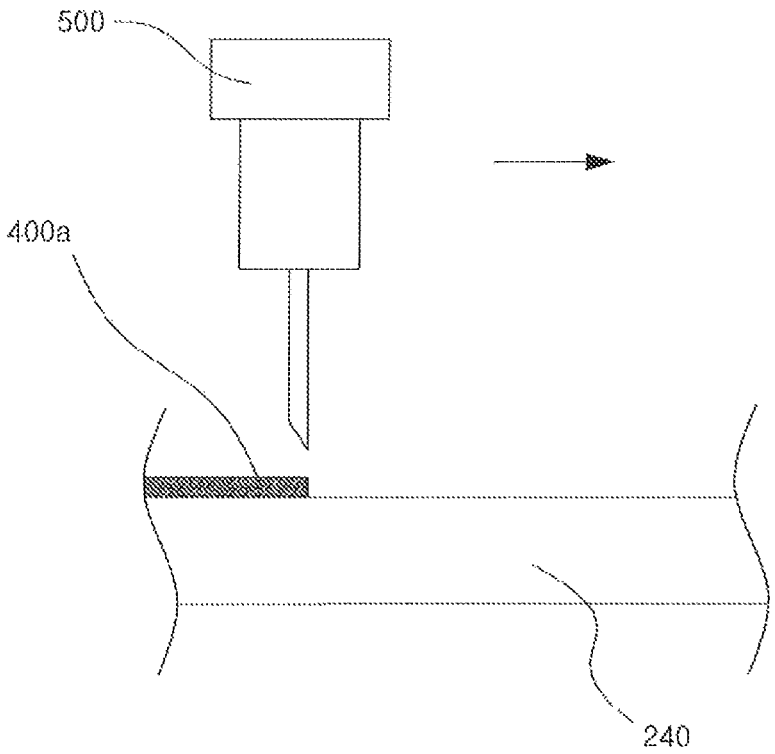
FIG. 9 is a schematic diagram illustrating an example in which an interval keeping means (using a viscous liquid) of the cooling module in accordance with the embodiment of the present invention is formed.

FIG. 9 illustrates an example of the interval keeping means, in which the interval keeping means illustrated in FIG. 9 is illustrated as, for example, a viscous liquid or fluid 400*a* which is applied to the second tube 240 in the second heat exchanger 200 at a predetermined thickness by a viscous liquid applicator 500.

In the form illustrated in FIG. 9, the interval keeping means is the viscous liquid 400*a*, in which the viscous liquid 400*a* is formed on a surface opposite to the first heat exchanger 100 of the plurality of second tubes 240 forming the second heat exchanger 200 and a surface opposite to the third heat exchanger 300 and is extendedly formed along the length direction of the second tube 240.

In this case, the viscous liquid 400*a* may be preferably applied to at least two second tubes 240 selected from the plurality of second tubes 240.

Figure 10:
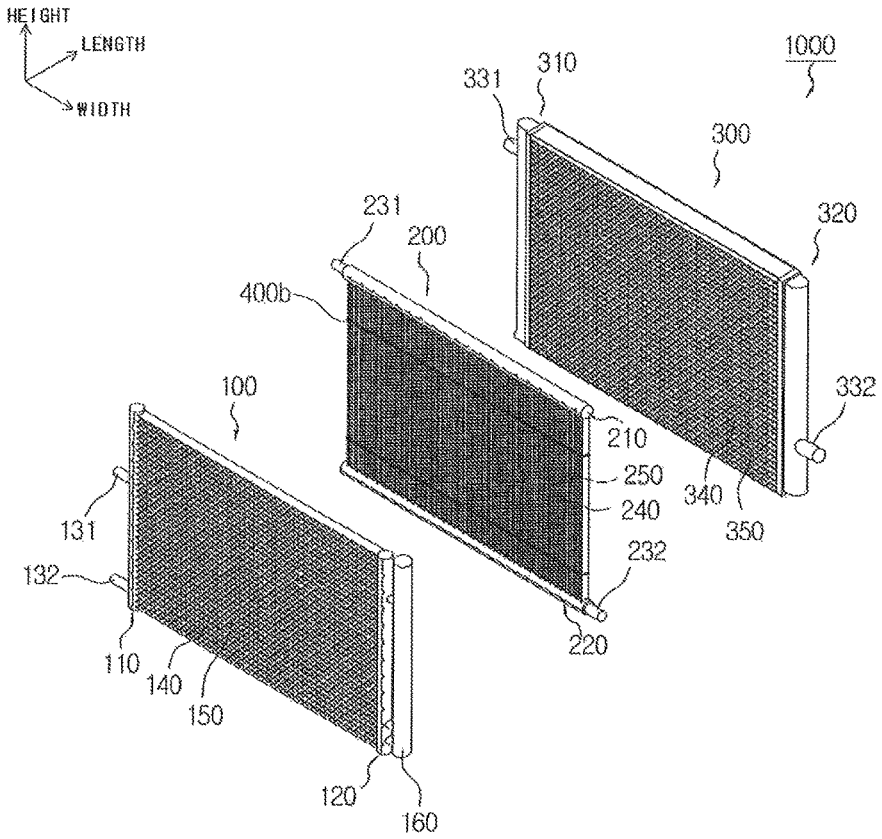
FIG. 10 is a diagram illustrating another interval keeping means of the cooling module in accordance with the embodiment of the present invention.

FIG. 10 illustrates another example of the interval keeping means, in which the interval keeping means illustrated in FIG. 10 may be a gasket 400*b* which two are provided in the height direction of the vehicle.

The gasket 400*b* is formed to completely enclose the second heat exchanger 200 to be able to keep the interval between the first heat exchanger 100 and the second heat exchanger 200 and the interval between the second heat exchanger 200 and the third heat exchanger 300 using a material thickness of the gasket 400*b*.

Figure 11:
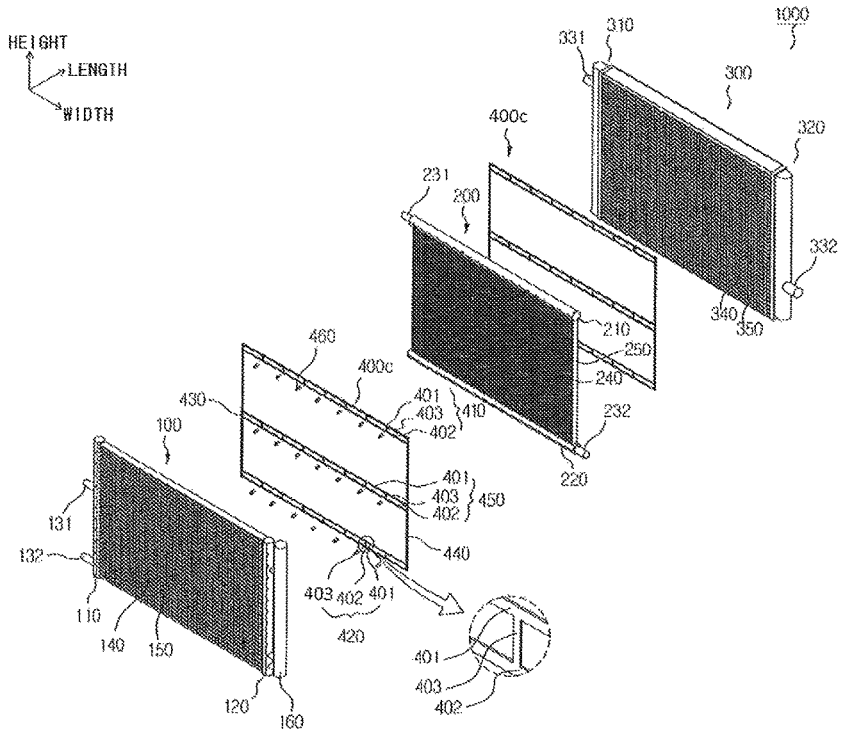
FIG. 11 is a diagram illustrating still another interval keeping means of the cooling module in accordance with the embodiment of the present invention.

FIG. 11 illustrates another example of the interval keeping means and illustrates an example in which an interval keeping means 400*c* illustrated in FIG. 11 is a frame 400*c* having a predetermined thickness which is fixed to the second heat exchanger 200 by a fixing means or structure 460.

In this case, the frame 400*c* has a size corresponding to the formation area of the second tubes 240 and the second fins 250 in the second heat exchanger 200 and may be configured to include a first frame 410, a second frame 420, a third frame 430, and a fourth frame 440.

The first frame 410 and the second frame 420 have the same shape and include a first support part 401 and a second support part 402 which are extendedly formed in the width direction of the vehicle and spaced apart from each other by a distance at which the fixing means 460 is inserted in the height direction of the vehicle and a fastening part 403 which connects the first support part 401 and the second support part 402 in the height direction of the vehicle and is fastened with the fixing means 460.

In this case, the first frame 410 forms an upper area in the height direction of the vehicle and is adjacently disposed to the 2-1-th header tank 210 and the second frame 420 forms a lower area in the height direction of the vehicle and is adjacently disposed to the 2-2-th header tank 220.

The fixing means 460 is a means of fixing the frame 400*c* and the second tubes 240 or the second fins 250 in the second heat exchanger 200 and may be very variously formed, including a ring shape.

Further, FIG. 11 illustrates an example in which the frame 400*c* includes the first frame 410 to the fourth frame 440 and a fifth frame 450 having the same shape as the first frame 410 and the second frame 420 is further disposed between the first frame 410 and the second frame 420.

The fifth frame 450 may more certainly keep the interval between the first heat exchanger 100 and the second heat exchanger 200 and the interval between the second heat exchanger 200 and the third heat exchanger 300 and may be further provided with the fixing means 460 to more increase the fixing force between the second heat exchanger 200 and the frame 400*c*.

As illustrated in FIG. 11, the frame 400*c* is provided at both sides of the second heat exchanger 200, respectively, in an air flow direction and the single fixing means 460 may simultaneously fix the second heat exchanger 200 and the interval keeping means at both sides thereof.

Meanwhile, although not illustrated in the drawings, the cooling module 1000 in accordance with the embodiment of the present invention may be a form in which the form illustrated in FIGS. 3 to 7 rotates 90°. In more detail, in the cooling module 1000 in accordance with the embodiment of the present invention, the first tubes 140 in the first heat exchanger 100 may be formed in the height direction of the vehicle, the second tubes 240 in the second heat exchanger 200 may be formed in the width direction of the vehicle, and the third tubes 340 in the third heat exchanger 300 may be formed in the height direction of the vehicle.

Therefore, in accordance with the embodiments of the present invention, the cooling module 1000 may sufficiently secure the first heat exchange medium condensing performance, the third heat exchange medium cooling performance, and the second heat exchange medium cooling performance and may be miniaturized.

Further, in accordance with the embodiment of the present invention, the cooling module 1000 may prevent the components in the first heat exchanger 100, the second heat exchanger 200, and the third heat exchanger 300 from contacting each other using the interval keeping means while reducing the interval between the first heat exchanger 100 and the second heat exchanger 200 and the interval between the second heat exchanger 200 and the third exchanger 300 to prevent vibration and noise from occurring and increase durability.

As described above, in accordance with the embodiments of the present invention, the cooling module may sufficiently secure the first heat exchange medium condensing performance, the third heat exchange medium cooling performance, and the second heat exchange medium cooling performance and may be miniaturized.

In particular, in accordance with the embodiments of the present invention, the cooling module may form in parallel the internal flow directions of the first heat exchanger and the third heat exchanger in which the third heat exchange medium flows and vertically form the internal flow directions of the first heat exchanger and the second heat exchanger in which the second heat exchange medium flows to reduce the interval between the first heat exchanger and the second heat exchanger and the interval between the second heat exchanger and the third heat exchanger.

Further, in accordance with the embodiments of the present invention, the cooling module may prevent the components of the first heat exchanger, the second exchanger, and the third exchanger from contacting each other by the interval keeping means while reducing the interval between the first heat exchanger and the second heat exchanger and the interval between the second heat exchanger and the third exchanger to prevent the vibration and noise from occurring and increase the durability.

The present invention is not limited to the aforementioned embodiment and an application range is various and it is apparent that various modifications can be made to those skilled in the art without departing from the spirit of the present invention described in the appended claims.

What is claimed is:

1. A cooling module comprising:

a first heat exchanger cooling a first heat exchange medium;

a second heat exchanger cooling a second heat exchange medium;

a third heat exchanger cooling a third heat exchange medium; and a fan and shroud assembly, the first heat exchanger, the second heat exchanger, the third heat exchanger, and the fan and shroud assembly in series with one another in an air flow direction, wherein the first heat exchanger is a condenser, the second heat exchanger is an electronic component radiator, and the third heat exchanger is an engine radiator, wherein the second heat exchanger is between the first heat exchanger and the third heat exchanger and a flow of the first heat exchange medium inside first tubes forming the first heat exchanger is perpendicular to a flow of the second heat exchange medium inside second tubes forming the second heat exchanger and is parallel to a flow of the third heat exchange medium inside third tubes forming the third heat exchanger.

2. The cooling module of claim 1, wherein the first heat exchanger includes a first header tank and a second header tank arranged in parallel, the first header tank of the first heat exchanger and the second header tank of the first heat exchanger spaced apart from each other by a predetermined distance in a width direction of a vehicle, the first tubes having a first end fixed to the first header tank of the first heat exchanger and a second end fixed to the second header tank of the first heat exchanger, and the first heat exchanger further includes first fins interposed between the first tubes, and wherein the second heat exchanger includes a first header tank and a second header tank arranged in parallel, the first header tank of the second heat exchanger and the second header tank of the second heat exchanger spaced apart from each other by a predetermined distance in a height direction of the vehicle, the second tubes having a first end fixed to the first header tank of the second heat exchanger and a second end fixed to the second header tank of the second heat exchanger, and the second heat exchanger further includes second fins interposed between the second tubes, and wherein the third heat exchanger includes a first header tank and a second header tank arranged in parallel, the first header tank of the third heat exchanger and the second header tank of the third heat exchanger spaced apart from each other by a predetermined distance in the width direction of the vehicle, the third tubes having a first end fixed to the first header tank of the third heat exchanger and a second end fixed to the second header tank of the third heat exchanger, and the third heat exchanger further includes third fins interposed between the third tubes.

3. The cooling module of claim 2, wherein in the height direction of the vehicle, a height H100 of a formation area of the first tubes and the first fins in the first heat exchanger, a height H200 of a formation area of the second tubes and the second fins in the second heat exchanger, and a height H300 of a formation area of the third tubes and the third fins in the third heat exchanger are equal.

4. A cooling module comprising:

a first heat exchanger;

a second heat exchanger; and a third heat exchanger, wherein the first heat exchanger, the second heat exchanger, and the third heat exchanger are arranged parallel to each other and are arranged in series with respect to an air flow direction, wherein the first heat exchanger is a condenser, the second heat exchanger is an electronic component radiator, and the third heat exchanger is an engine radiator, wherein the second heat exchanger includes storage tanks at an upper end and a lower end and each of the first heat exchanger and the third heat exchanger includes storage tanks at lateral side ends thereof.

5. The cooling module of claim 4, wherein the storage tanks of the first heat exchanger and the third heat exchanger are disposed between the storage tanks of the second heat exchanger.

6. The cooling module of claim 4, wherein a flow of a first heat exchange medium inside first tubes of the first heat exchanger is perpendicular to a flow of a second heat exchange medium inside second tubes of the second heat exchanger and the flow of the first heat exchange medium is parallel with a flow of a third heat exchange medium inside third tubes of the third heat exchanger.

* * * * *